United States Patent [19]

Pyles

[11] Patent Number: 4,838,132

[45] Date of Patent: Jun. 13, 1989

[54] ADJUSTABLE WRENCH

[75] Inventor: Donald Pyles, Rte. 9, Box 1116, Kemp, Tex. 75143

[73] Assignee: Donald Pyles, Dallas, Tex.

[21] Appl. No.: 97,329

[22] Filed: Sep. 10, 1987

Related U.S. Application Data

[63] Continuation of Ser. No. 357,062, Mar. 11, 1982, abandoned.

[51] Int. Cl.[4] ..... B25B 13/78; B25B 13/16

[52] U.S. Cl. ..... 81/111; 81/158; 81/176; 81/166; 81/170; 81/186

[58] Field of Search ..... 81/93, 97, 101, 111, 81/118, 151, 157, 158, 166, 170, 175, 176, 186

[56] References Cited

U.S. PATENT DOCUMENTS

| | | | |
|---|---|---|---|
| 54,820 | 5/1866 | Page . | |
| 149,944 | 4/1874 | Micks . | |
| 515,070 | 2/1894 | Carpenter . | |
| 564,513 | 7/1896 | Friede . | |
| 592,199 | 10/1897 | Fletcher . | |
| 1,153,399 | 9/1915 | Melheim | 81/97 |
| 1,556,523 | 10/1925 | Hughes | 81/186 X |
| 1,966,773 | 7/1934 | Tilston . | |
| 2,748,638 | 6/1956 | Walker | 81/101 |
| 2,754,710 | 7/1956 | Cullen . | |
| 3,015,246 | 1/1962 | Buyer . | |
| 3,280,668 | 10/1966 | Woodling | 81/101 |
| 3,318,176 | 5/1967 | Geier, Jr. . | |
| 3,881,377 | 5/1975 | Evans et al. | 87/186 |
| 4,084,456 | 4/1978 | Pasbrig . | |
| 4,324,159 | 4/1982 | Wrobbel . | |

FOREIGN PATENT DOCUMENTS

| | | | |
|---|---|---|---|
| 610584 | 6/1926 | France | 81/166 |
| 176005 | 5/1922 | United Kingdom . | |
| 404543 | 1/1934 | United Kingdom | 81/111 |
| 446903 | 5/1936 | United Kingdom | 81/186 |

*Primary Examiner*—James G. Smith

*Attorney, Agent, or Firm*—Sigalos, Levine & Montgomery

[57] ABSTRACT

An adjustable wrench comprising a handle, a stationary outer jaw member integrally formed with the handle and having at least one outer face and a support surface for a moveable jaw, and a moveable jaw member riding on the support surface and continuously supported thereby during its entire range of movement, the moveable jaw member having an inner face parallel to the stationary outer face whereby the turning of a nut placed between the stationary outer face and the moveable inner face creates a force a part of which is applied to the moveable jaw member in a direction perpendicular to the direction of travel of the moveable jaw member thereby forcing the moveable jaw member against the support surface.

23 Claims, 8 Drawing Sheets

OPEN

CLOSED

ADJUSTABLE WRENCH

This application is a continuation of application Ser. No. 357,062, filed Mar. 11, 1982 now abandoned.

BACKGROUND OF THE INVENTION

The present invention relates to an adjustable wrench and in particular to an adjustable wrench which is so constructed as to prevent or minimize a turning or twisting movement of the moveable jaw of the wrench during operation thereof and to maintain the close fit of the moveable jaw face and the stationary jaw face about a nut when the nut is being loosened or tightened.

There are many different types of adjustable wrenches found in the prior art. Those having a moveable or an adjustable jaw are constructed with threads which are utilized to move the adjustable jaw face towards or away from the stationary jaw face. The construction of these wrenches is such that when a force is applied to a nut to be turned, the force applies a turning moment or twisting moment to the moveable jaw member thus causing it to pivot away from the surface on which it rests about a point which tends to apply undue pressure to the threads or the pivot point thus causing the jaw to loosen and the threads to be damaged so that with continued use, the adjustment becomes more and more difficult to maintain. Thus, in each of the prior art wrenches, the forces applied during operational use of the wrench tend to force the moveable jaw away from the support surface on which it rides. It is this structural defect which creates the problems with the prior art adjustable wrenches.

The present invention overcomes the defect of the prior art adjustable wrenches by providing a support surface on which the moveable jaw member can rest and by so constructing the jaw member face of the moveable jaw that when the wrench is used the forces generated are applied to the moveable jaw face in such a direction as to force the moveable jaw member tightly against the support surface thereby removing undue stresses and strains from the moveable jaw member and tending to hold the moveable jaw member fixedly in place during use of the wrench. Thus, with the present inventive construction, it is impossible for the moveable jaw member to be separated even minutely from the support surface upon which it rests and moves and thus it is not subject to bending or twisting. Because of this unique construction, the wrench body has greater strength and stability and does not have to be made of such thick construction as do ordinary adjustable wrenches. Further, the wrench tends to stay tightly fit about a nut during use.

Also, no ratchet wrenches are known to applicant which utilize the above disclosed principle wherein the wrench, in the direction of applying force to the bolt or nut generates forces which are applied to the moveable jaw face in such a direction as to force it tightly against the support surface on which it rests thereby removing undue stresses and strains from the moveable jaw member but at the same time allowing the wrench to ratchet when it is turned in the opposite direction.

SUMMARY OF THE PRESENT INVENTION

Thus the present invention relates to an adjustable wrench comprising a handle, a stationary jaw member having at least one face and a support surface for a moveable jaw member all integrally formed and having an included angle of 60° between said stationary jaw member face and said support surface for receiving an object, and a moveable jaw member riding on said support surface and attached to said wrench and having a face parallel to said stationary jaw member face whereby said object may be held between said stationary jaw member face and said moveable jaw member face.

BRIEF DESCRIPTION OF THE DRAWINGS

These and other more detailed and specific objectives will be disclosed in the course of the following specification, reference being had to the accompanying drawings in which:

FIG. 13*b* is a plan view of the ratchet mechanism used in the wrench of FIG. 13*a.

DETAILED DESCRIPTION OF THE DRAWINGS

Figure 1:
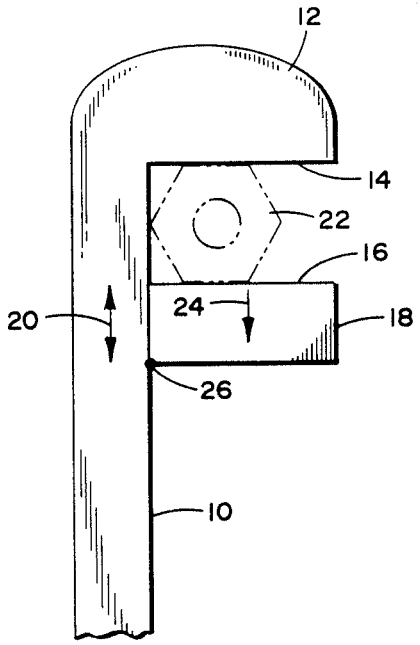
FIG. 1 is a partial schematic representation of a prior art open end adjustable wrench.

The prior art includes many open end and box end adjustable wrenches having a moveable jaw. However, these wrenches are so constructed that, during use, forces are applied to the moveable jaw which cause twisting or turning moments which can distort the moveable jaw and not only cause damage to the wrench but also prevent a firm grip from being maintained on the object to which the wrench is applied. For instance, the open end wrench partially illustrated in FIG. 1 has a handle portion 10 and a stationary jaw member 12 integrally formed together. The stationary jaw member 12 has a face 14 which is parallel to and spaced from a face 16 of a movable jaw member 18 which is mounted in a well known manner to the handle 10. By adjusting the moveable jaw 18 in either direction along the path indicated by arrow 20, the space between faces 14 and 16 can be adjusted so that various size objects such as hexnut 22 can be gripped by the open end wrench for installation or removal. It will be noted, however, that when any force is applied to turn hexnut 22, that force is applied in the direction of arrow 24 thus applying a turning moment to moveable jaw 18 about pivot point 26. If handle 10 is of any length, a great deal of pressure can be applied to the wrench thus causing a large twisting moment in the direction of arrow 24 about pivot point 26 which can deform moveable jaw 18 and cause it to slip over the corners of hexnut 22 or otherwise permanently deform moveable jaw 18. Examples of such wrenches are found in British Pat. No. 176,005 and U.S. Pat. Nos. 176,005, 515,070, 564,513, 1,966,773 and 3,015,246. Obviously such wrenches are at a disadvantage inasmuch as they may actually become deformed or may deform sufficiently to slip over the hexnut or other object in the grip of the wrench.

Figure 2:
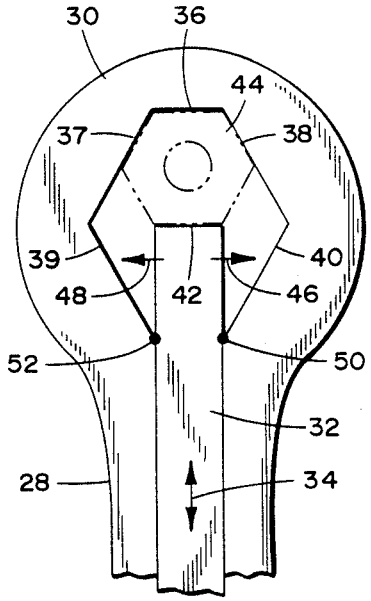
FIG. 2 is a partial schematic of a box end prior art adjustable wrench.

In like manner, closed end adjustable wrenches are also subject to deformation of the moveable jaw. Consider FIG. 2 which is a partial representation of a closed end adjustable wrench having a handle 28, a stationary jaw member 30, and a moveable jaw member 32 which is moved in any well known manner in the direction of arrow 34. Stationary jaw member 30 has at least one face 36 and, as in the particular embodiment shown, may have several additional faces 37, 38, 39, and 40. Moveable jaw member 32 has a face 42. When the moveable jaw 32 is positioned so as to engage a hexnut 44 as shown, any force applied to handle 28 to turn hexnut 44 causes a force to be applied to the end of moveable jaw 32 in the direction of the arrows 46 and 48. Such force causes a twisting or bending moment about pivot points 50 or 52 thus attempting to distort or twist moveable jaw 32. Again, this type of construction allows the wrench either to become physically distorted or perhaps allows it to distort sufficiently so that the moveable jaw 32 can slip over the corners of hexnut 44 thus deforming the corners.

Figure 3:
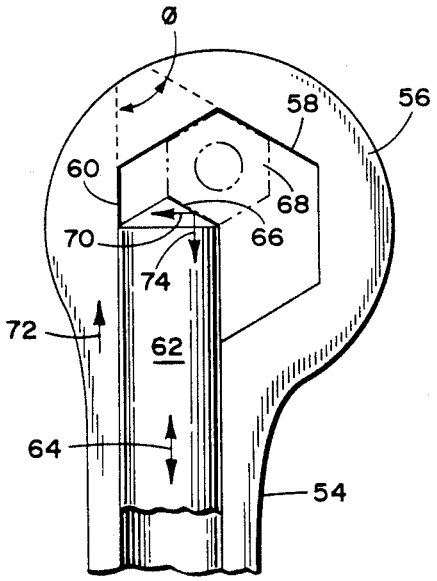
FIG. 3 is a partial schematic representation of a box end adjustable wrench illustrating the novel and unique principles of the present invention.
Figure 4:
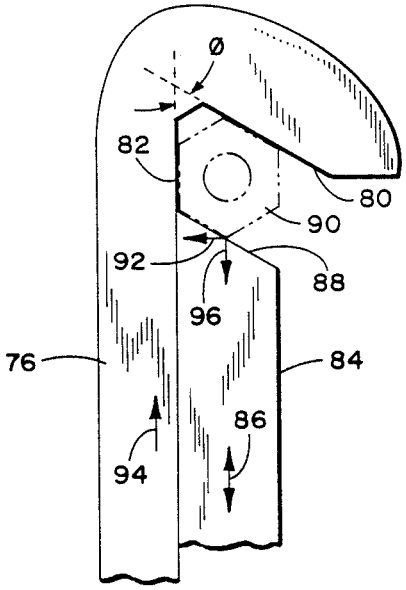
FIG. 4 is a partial schematic representation of an open end wrench illustrating the construction of such wrench utilizing the unique and novel principles of the present invention.

The disadvantages of the prior art open and closed end adjustable wrenches are overcome by the novel features of the present invention. The principles of the present invention are illustrated in FIGS. 3 and 4 and in which FIG. 3 is a partial view of the preferred embodiment of a boxed end adjustable wrench utilizing the principles of the present invention. Thus the wrench in FIG. 3 has a handle 54 and a head portion 56 integrally formed therewith. Head 56 has at least one stationary working face 58 and a moveable jaw support surface 60. Face 58 of stationary jaw member 56 and the support surface 60 are separated by an included angle which equals 60°. Moveable jaw 62 rides on support surface 60 and is continuously supported thereby during its entire range of movement in the direction of arrow 64. Moveable jaw 62 has a working face 66 which is parallel to stationary member face 58 whereby pressure applied to hexnut 68 which is placed between stationary jaw member face 58 and said moveable jaw member face 66 creates a force, a part of which is applied to the moveable jaw member 62 in the direction of arrow 70 which is perpendicular to the direction of travel of the moveable jaw member 62 thereby forcing moveable jaw member 62 against support surface 60 which prevents turning or twisting of moveable jaw member 62. The component of pressure applied in the direction of arrow 70 to moveable jaw member 62 creates a friction between moveable jaw member 62 and support surface 60 which is in the direction of arrow 72 thus opposing the other component of force in the direction of arrow 74 which is parallel to the direction of travel of moveable jaw member 62. Thus pressures generated by turning a nut or other object with the wrench is applied to the moveable jaw member 62 such that it is held tightly against the support surface 60 and thus creates a friction which opposes any pressures applied to the moveable jaw member 62 parallel to the direction of travel. This unique construction renders it impossible for the moveable jaw member 62 to be separated even minutely from the support surface 60 upon which it rests and thus it is impossible to apply a twisting moment or bending moment to moveable jaw member 62 and it therefore tends to remain fixed snugly in its original position.

The preferred embodiment for illustrating the novel principles with an open end wrench is shown in FIG. 4 which illustrates a partial view of an open end wrench including a handle 76 and a stationary jaw member 78 integrally formed with handle 76 and having at least one jaw member face 80 and a moveable jaw support surface 82. Jaw member face 80 and support surface 82 are again separated by an included angle which is a 60° angle. A moveable jaw 84 rides on support surface 82 and again is continuously supported thereby during its entire range of movement in the direction of arrow 86. Moveable jaw 84 has a working face 88 which is parallel to the stationary jaw member face 80 whereby pressure applied to an object such as a hexnut 90 creates a force a part of which is applied to moveable jaw member 84 in a direction 92 which is perpendicular to the direction of travel 86 of the moveable jaw member 84 thereby forcing the moveable jaw member 84 against support surface 82 to prevent turning or twisting of moveable jaw member 84. Again, the pressure applied to moveable jaw member 84 in the direction of arrow 92 causes a frictional force to be developed between support surface 82 and moveable jaw member 84 in the direction of arrow 94 which opposes the component of force developed along arrow 96 which is parallel to the direction of movement of moveable jaw member 84 and thus reduces this pressure. Consequently, moveable jaw member 84 is prevented from being separated even minutely from support surface 82 and thus no turning or twisting moments can be applied thereto.

Figure 5:
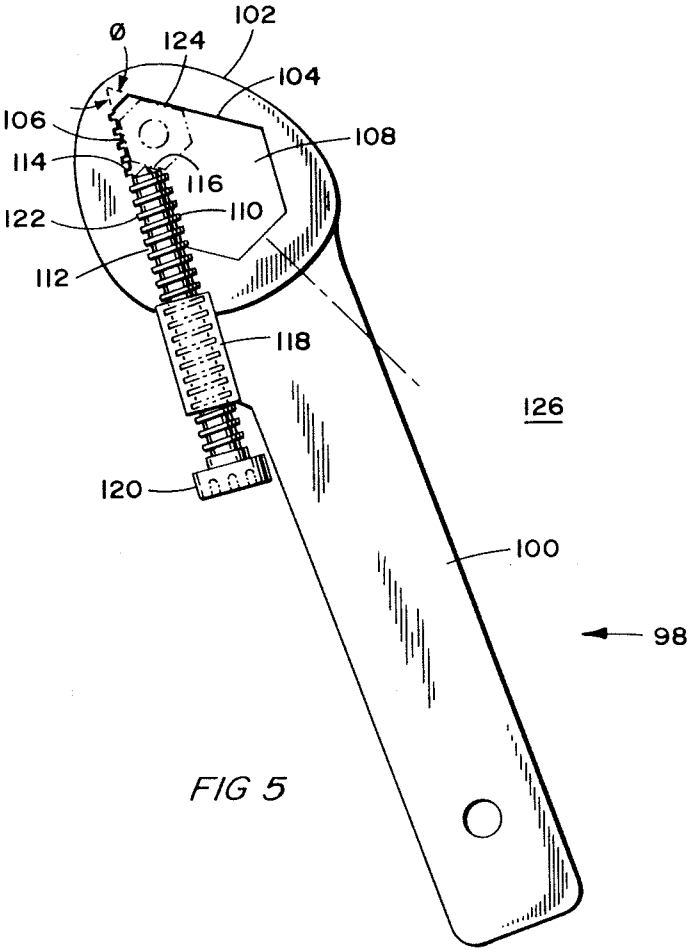
FIG. 5 illustrates one embodiment of a closed end adjustable wrench utilizing the principles of the present invention.

FIG. 5 illustrates a very simple form of an adjustable box end wrench which can be constructed utilizing the principles of the present invention. Thus wrench 98 includes a handle 100, a head portion 102 which forms a stationary jaw integrally formed therewith and having at least one jaw member face 104 and a support surface 106 for a moveable jaw member. Stationary jaw member face 104 and support surface 106 are separated by a 60° included angle and both face 104 and support surface 106 are elongated in a converging direction to allow the wrench 98 to be used with different size nuts. Thus an opening may be formed in stationary jaw member 102 in the form of a hexagon 108 with the two sides 104 and 106 elongated to allow smaller size nuts to be accommodated. The maximum size nut that can be accommodated is, of course, the size of the hexagon itself.

The moveable jaw member 110 is simply a rotatable bolt having threads 112 thereon and having a conical shaped end 114 with an included angle of 120° whereby the side of the cone formed on said conical shaped end 114 will form a moveable jaw member face 116 which is parallel to the stationary jaw member face 104 in any rotated position of said bolt 110. Rotatable bolt 110 is mounted in a threaded socket 118 and has on the end thereof a knurled nut 120 for easily turning said threaded bolt 110. Further, if desired, threads 122 may be formed in the support surface 106 so that the rotating bolt 110 will rest therein and will resist any lateral forces which may be applied to it if the wrench is improperly positioned around nut 124. Threadedpassage 118 extends through and into the stationary jaw member 102 in alignment with moveable jaw support surface 106 for receiving threaded bolt 110. As will be noted, stationary jaw member 102 is integrally formed at an angle 126 with handle 100. Angle 126 may vary depending upon the desired mounting position of rotatable bolt or moveable jaw member 110. Stationary jaw member 102 may be placed at any particular angle 126 with respect to handle 100 so long as moveable jaw member 110 always rests firmly against support surface 106.

Figure 6B:
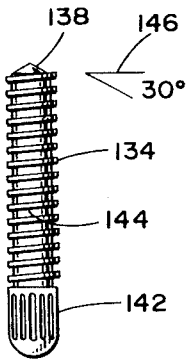
FIG. 6*b* illustrates the construction of the moveable jaw utilized in the wrench of FIG. 6*a;*
Figure 6A:
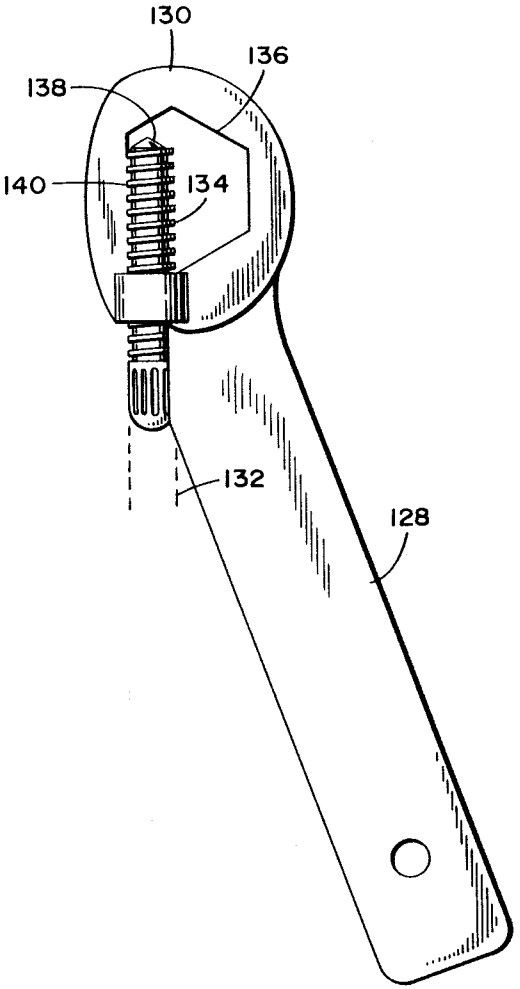
FIG. 6*a* illustrates a second embodiment of a closed end adjustable wrench utilizing the principles of the present invention and having only two components.

FIG. 6*a* is a second embodiment of a closed end adjustable wrench utilizing the principles of the present invention and which has simply two parts as did the wrench of FIG. 5. In this case the rotatable bolt forming the moveable jaw member is at an angle 132 with respect to the wrench handle whereas in FIG. 5, the rotatable bolt 110 forming the moveable jaw member was positioned parallel to the handle 100. Thus the construction of the wrench illustrated in FIG. 6*a* is identical to that illustrated in FIG. 5 except that the stationary jaw member 130 is at such an angle 132 with respect to handle 128 that moveable jaw 134, which is a rotatable screw or bolt, is at an angle to, instead of parallel with, handle 128. Note again that the included angle between face 136 and support surface 140 is 60° and that face 138 of moveable jaw member 134 is parallel to stationary face 136 in any rotated position of bolt 134. As may be seen in FIG. 6*b*, grooves 142 are formed on one end of rotatable bolt 134 transversely to threads 144. Further, as can be seen in FIG. 6*b*, the conical end of rotatable bolt 134 forming moveable face 138 has an included angle of 120° and the side of the cone forms a 60° angle with a line 146 which is perpendicular to the direction of travel of the moveable jaw member 134.

Figure 7C:
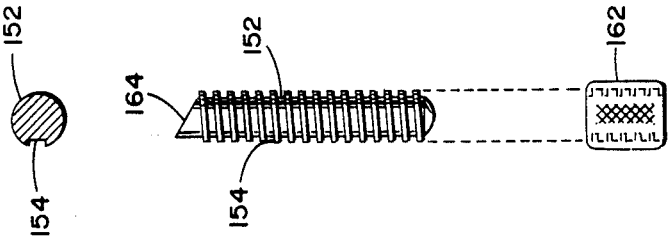
FIG. 7*c* illustrates the construction of the moveable jaw member of the closed end wrench illustrated in FIG. 7*a;*
Figure 7B:
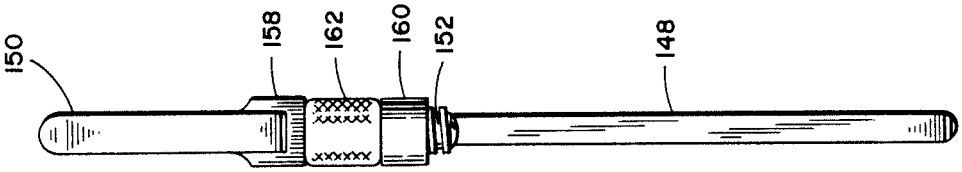
FIG. 7*b* is a side view of the novel wrench of FIG. 7*a;*
Figure 7A:
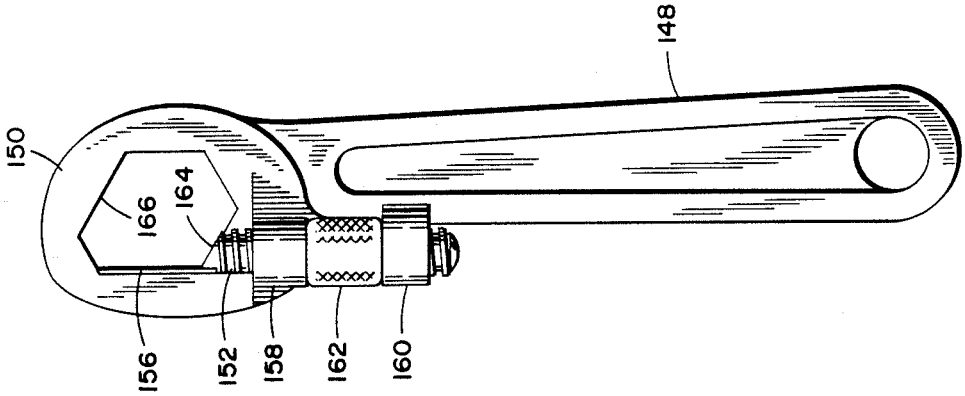
FIG. 7*a* is a plan view of another alternate embodiment of a closed end adjustable wrench utilizing the principles of the present invention.

In the embodiment shown in FIG. 7*a*, the features of the wrench are generally identical to those previously discussed except for the manner in which the moveable jaw member is constructed. In this particular case, the moveable jaw 152 is adjusted by means for slidinq the moveable jaw member 152 instead of rotating it. A recess 154 is formed in the base of moveable jaw 152 as illustrated in FIG. 7*c* in the cross sectional view which fits over support surface 156 to prevent any lateral movement. A first threaded orifice 158 is formed in head member 150 in alignment with the moveable jaw support surface 156 and a second orifice 160 is formed on said wrench spaced from and in alignment with first orifice 158 and a threaded nut 162 is mounted between the first and second orifices 158 and 160, respectively, for receiving the threaded bolt or moveable jaw member 152 and causing said bolt 152 to have a sliding motion upon rotation of nut 162. Again, note that in any position of moveable jaw 152, face 164 is always parallel to stationary face 166 of stationary jaw 150. Also note again that stationary face 166 and support surface 156 are elongated and form an included angle of 60°. If desired, of course, a recess may be placed in support surface 156 and a mating projection may be formed on the bottom of said slidable bolt or moveable jaw 152 for mating with the recess in order to prevent any rotation of bolt 152 and to cause a sliding motion to be imparted thereto. It will, of course, also prevent any transverse movement of said sliding bolt 152.

Figure 8B:
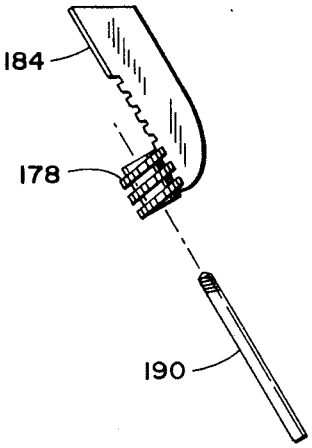
FIG. 8*b* is a representation of the moveable jaw member and its associated components which are utilized in the adjustable wrench of FIG. 8*a;*
Figure 8A:
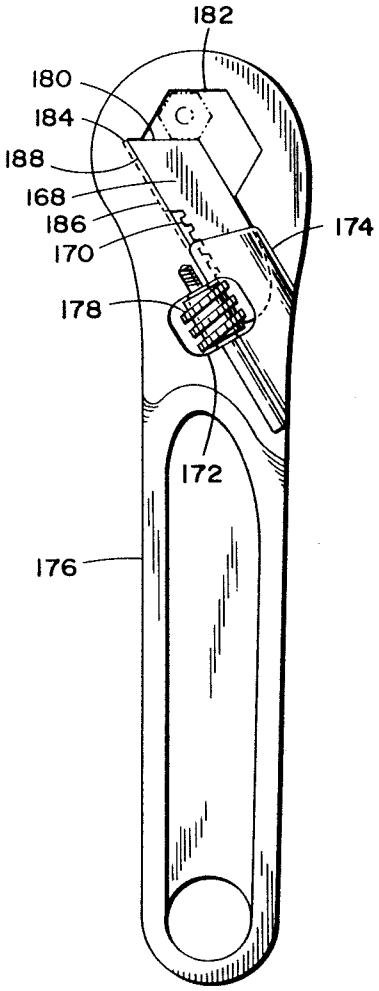
FIG. 8*a* is still another alternate embodiment of a closed end adjustable wrench utilizing the principles of the present invention.

FIG. 8*a* discloses still another embodiment of a box end wrench utilizing the principles of the present invention. In this case, the moveable jaw member 168 has partial threads 170 formed on the lower part thereof and a cavity 172 is formed in the wrench body 176 which is in communication with the partial threads 170 on the moveable jaw member 168. A nut 178 having external threads thereon is mounted in cavity 172 and cooperates with the partial threads 170 to move the jaw member 168 and associated moveable jaw face 180 toward or away from the stationary jaw face 182 as nut 178 is turned. The moveable jaw member 168 is slidably inserted in orifice 174 in wrench body 176 and has a projection 184 on the lower part thereof for mating with a recess 186 in moveable jaw support surface 188. This mating of recess 186 and projection 184 prevents any lateral or rotatable movement of the moveable jaw member 168. Again, at all times the moveable jaw face 180 and the stationary jaw face 182 are parallel to each other.

Also, stationary face 182 and support surface 188 could be extended in the converging direction if desired with an included angle of 60°. Here, a second stationary jaw member face 183 forms an included angle of 120° with the first stationary jaw member 182 whereby hexnut 185 is held by faces 182, 183 and moveable face 180.

As indicated in FIG. 8*b*, nut 178 is held in place in cavity 172 by means of threaded pin 190 which passes through an orifice (not shown) in nut 178 and is secured to wrench body 176. Thus this embodiment of the novel wrench has four total parts.

Figure 9:
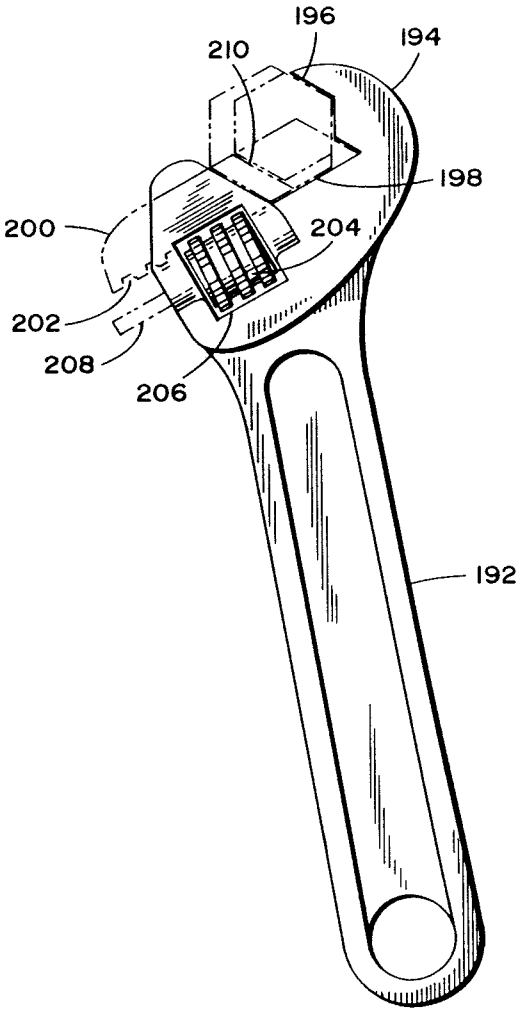
FIG. 9 is a representation of an open end adjustable wrench which utilizes the novel principles of the present invention.

FIG. 9 is a plan view of a novel open end wrench which utilizes the unique principles of the present invention. The open end wrench comprises a handle 192 with which is integrally formed a head member 194 having a stationary jaw member face 196 and a moveable jaw support surface 198. It will be noted again that the included angle between fixed jaw face 196 and moveable jaw support surface 198 is 60°. Again, moveable jaw 200 rests on support surface 198 and has on the lower part thereof partial threads 202 which are in engagement with external threads on a rotatable nut 204 which is located in a cavity 206 in the wrench body. A pin 208 holds the nut 204 in cavity 206. By rotating nut 204 which is an engagement with partial threads 202 on the moveable jaw 200, jaw 200 moves towards or away from the fixed jaw face 196. Also, the moveable jaw 200 has a face 210 which is always maintained in a parallel relationship to the fixed jaw face 196.

With each of the wrenches previously described, certain features are always apparent. First, there is always an included angle of 60° between the fixed jaw face and the moveable jaw support surface. Secondly, the fixed jaw face and the moveable jaw support surface are an integrally formed unit. Thirdly, the moveable jaw face and the fixed jaw face are always parallel to each other. This means that the moveable jaw face is always at an angle of 60° with respect to the support surface on which it rests. Fourth, the fixed jaw face and the support surface may be extended in a converging direction to accommodate various size nuts. Finally, the construction of the wrenches is such that when in use, the forces applied to the various parts of the wrench never cause the moveable jaw to tend to separate from the support surface on which it rests. Thus there is no tendency for the moveable jaw member to bend or twist under pressure but to rest securely on the support surface. Further, by elongating the fixed jaw face and the moveable jaw support surface in the direction of their convergence, the wrenches can be used with varying size nuts. Also, because the force is applied to the moveable jaw member in a direction to tend to hold it against the support surface on which it rests, it allows the wrench to be made of less thickness than prior art wrenches because it is strengthened by preventing twisting movement of the moveable jaw member.

It is obvious that the moveable jaw member could be inserted in the wrench body in a number of ways as, for instance, inserted in a cavity on one side of the wrench and holding it in place by a clip and utilizing a nut with internal threads to move the jaw member towards or away from the fixed jaw member. Also, the moveable jaw member face could be constructed as a pivotable unit mounted on the end of the moveable jaw member so that it does not rotate but maintains its position as it moves towards or away from the fixed jaw face while the moveable member rotates.

Thus there has been disclosed a novel and unique principle for use with both open end and closed end wrenches for making the wrenches stronger, of thinner construction, and more dependable.

Figure 11:
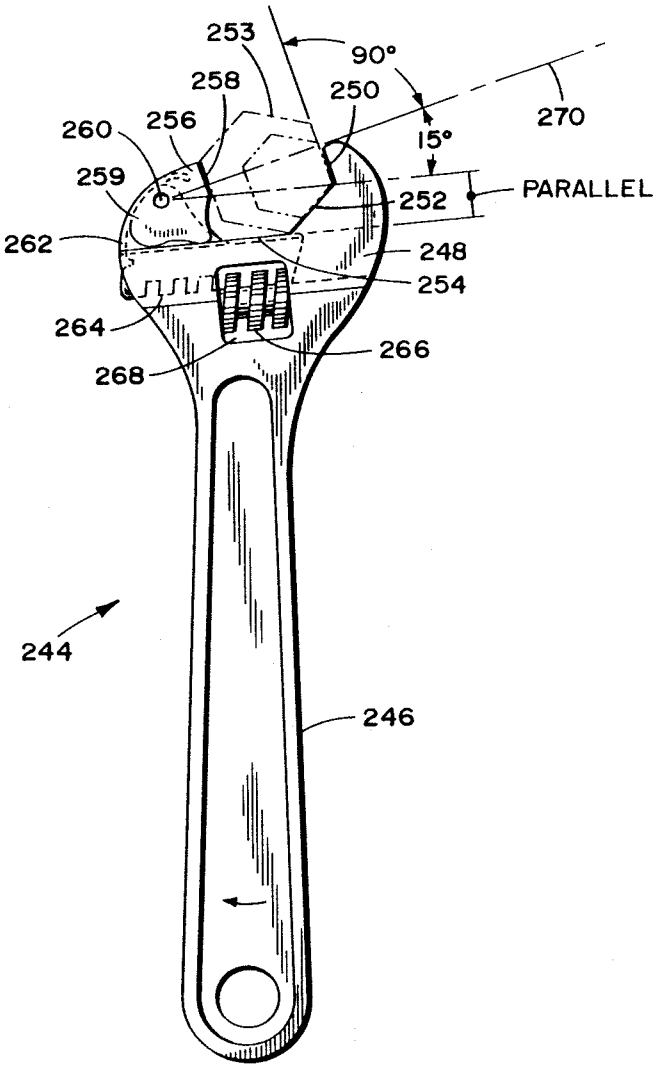
FIG. 11 is a plan view of one embodiment of an adjustable ratchetable wrench.
Figure 10:
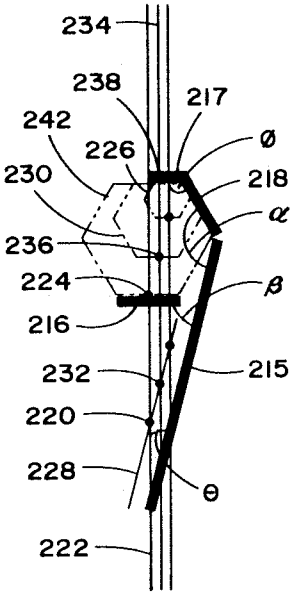
FIG. 10 is a diagram representing the forces and their relationships to the moveable jaw and the working faces of the novel adjustable ratchetable wrench.

FIG. 10 is a diagram which represents the forces which are present on the components of a ratchetable adjustable wrench. As disclosed in FIG. 10, a dark line 215 represents the support surface for the moveable jaw while dark line 216 represents the working face for either the moveable jaw or the fixed jaw. In like manner, heavy dark line 217 represents the first working face of either the moveable jaw or the fixed jaw while dark line 218 represents the second working face of either the moveable or the fixed jaw. Working face 216 may be on the moveable jaw as shown in FIG. 11 at 258 or may be on the fixed jaw as illustrated in FIG. 13 at 314. In like manner, heavy dark line 217 may represent the first working face 250 of the fixed jaw member as illustrated in FIG. 11 or the first working face 318 of the moveable jaw member as illustrated in FIG. 13. For purposes of this discussion, however, heavy dark line 216 will be hereinafter referred to as the working face of the moveable jaw while heavy dark lines 217 and 218 will be referred to as the first and second working faces respectively of the fixed jaw member, it being understood that the description is for purposes of discussion only and the terms could be reversed according to the particular wrench configuration. Point 220 represents the pivot point of the moveable jaw member having working face 216. Pivot point 220 always lies on a line passing through the center of the parallel sides of the nut or bolt held by the abutting fixed and moveable jaws. For instances, pivot point 220 lies on line 222 which passes through point 224 and point 226 which represent the mid points of the parallel sides of the nut 242 in FIG. 10 which is held by the abutting fixed and moveable jaws 216 and 217 respectively. As the moveable jaw working face 216 moves toward fixed working face 217, the pivot point 220 moves along line 228. Thus, when smaller nut 230 is to be turned, the moveable working face 216 moves inwardly until it abuts the face of nut 230 and pivot point 220 has moved to the point indicated at 232. However, at this point it is noted that the pivot point 220 rests on line 234 which passes through points 236 and 238 which are the centers of the parallel sides of nut 230. The angle Theta ($\theta$) which is the angle between the line passing through the pivot point 220 and the center of the parallel sides of the nut held by the abutting fixed and moveable jaws and the support surface 215 is equal to 15°. The angle Phi ($\phi$) which is the angle between first working face 217 and second working face 218 is, of course, 120° to accommodate a hexnut. The angle Alpha ($\alpha$) between the support surface 215 and the second working face 218 is 135°. The angle Beta ($\beta$) between moveable face 216 and support surface 215 is 75°. The largest nut which can be accommodated by this adjustable wrench illustrated diagrammatically in FIG. 10 is a nut whose length of one side thereof is equal to the length of the second face 218. The wrench cannot adequately accommodate a of larger size. Further, the length of the first working face 217 must be sufficient to extend no more than one half the distance along one face of the largest size hexnut accommodated by the wrench. Thus, in FIG. 10, the length of first working face 217 must be such that it does not extend more than one half the distance along the face of nut 242 which abutts working face 217. Under these conditions as set forth in FIG. 10, the wrench can be adjustable and also ratchetable.

FIG. 11 illustrates one embodiment of a wrench which is both adjustable and ratchetable. In FIG. 11, the wrench is shown generally as numeral 244 and includes a handle 246, a stationary jaw member 248 having a first working face 250 and a second working face 252 integrally formed with a support surface 254. It will be seen that first working face 250 contacts approximately the lower half of one face of nut 253. As the nut size becomes smaller, however, it will be seen that first working face 250 covers a larger proportion of the abutting face of nut 253 until, with small nuts, the abutting face is entirely covered. Resting on support surface 254 is a moveable jaw 256 which has a working face 258, and which is pivotally attached to a base 259 at pivot point 260. It can be seen that working face 258 of moveable jaw 256 only contacts approximately the upper half of the face of nut 253 which is opposite to and parallel the nut face contacted by stationary working face 250. However, as the size of the nut decreases, the pivot point 260 moves along a line parallel to the support surface 254 as shown in FIG. 11 thus allowing the working face 258 of moveable jaw 56 to always contact approximately the upper half of the face of nut 253 which is opposite to and parallel the nut face contacted by stationary working face 250. It will also be noted in FIG. 11 that the portion of moveable jaw 256 below face 258 is curved inwardly and away from nut 253 to allow ratcheting to occur. A spring 262 holds the moveable jaw 256 to base 259. Base 259 has threads 264 on the bottom thereof which engage a knurled, threaded nut 266 which rests in a slot 268. Knurled, threaded nut 266 is held in place in a well known manner by a threaded shaft extending through the center thereof (not shown) and when the knurled nut is turned, it engages threads 264 which cause the base 259 to move towards or away from the first working face 250 of the stationary jaw member. As will be seen, the length of second working face 252 determines the maximum size nut 253 which can be accommodated by wrench 244 and, in the position shown in FIG. 11, the pivot point 260 of moveable jaw 256 lies on line 270 which passes through the center of the parallel sides of the nut 253 held by the abutting fixed and moveable jaws 250 and 258. Spring 262 allows the moveable jaw 256 to pivot about point 260 when the wrench is turned counterclockwise in FIG. 11 and returns the moveable jaw 256 to a point where it rests on support surface 254 when the wrench is turned clockwise.

Figure 12A:
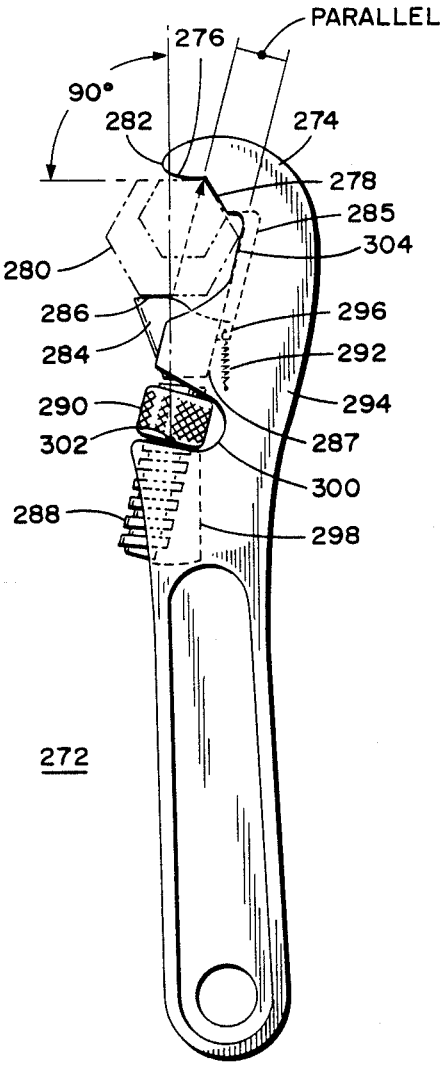
FIG. 12*a* is a plan view of a second embodiment of an adjustable ratchetable wrench.
Figure 12B:
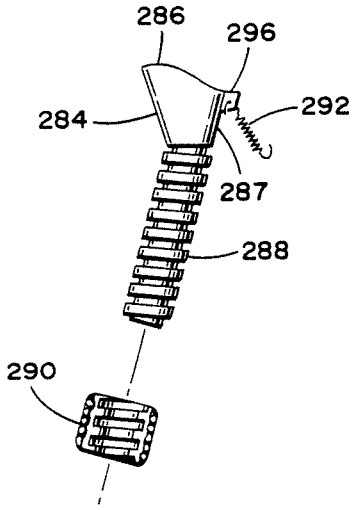
FIG. 12*b* is a representation of the ratchet mechanism utilized in the wrench of FIG. 12*a;*

In FIG. 12*a*, another embodiment of a wrench 272 is illustrated. In this embodiment, the stationary jaw member 274 includes the first working face 276 and second working face 278 which are separated by an angle of 120° to accommodate a hexnut. First working face 276 extends approximately one half the distance along one face of the largest size hexnut 280 which can be accommodated by the wrench. At that point, the outer end 282 of first working face 276 arches away from said hexnut 280 to enhance the ratcheting ability of the wrench. Moveable jaw 284 has a working face 286 and is integrally formed with a screw or threaded member 288 which passes through a knurled nut 290. By turning knurled nut 290, the moveable face 284 is caused to move towards or away from the first working face 276 on fixed or stationary jaw member body 274. A spring 292 is coupled between the wrench body 294 and a lip 296 which forms part of the moveable jaw 284 and which rests in a slot 285. A slot 298 in wrench body 294 is enlarged as it moves rearwardly from the slot 300 in which the knurled nut 290 rests. This allows the moveable jaw to pivot about point 302 when the wrench is ratcheted. After the ratcheting ceases, the spring 292 returns the moveable jaw back to a position where its base 287 rests on a support surface 304. In FIG. 12(*b*), the details of the moveable jaw member are indicated. Thus, jaw member 284 has a working face 286 and a lip 296 at the bottom thereof to which spring 292 is attached. It is also rigidly attached to a threaded body 288 which passes through a knurled nut 290 which, when turned, causes the moveable jaw member 284 to move towards or away from the stationary jaw member. Base 287 rests on support surface 304.

Figure 13A:
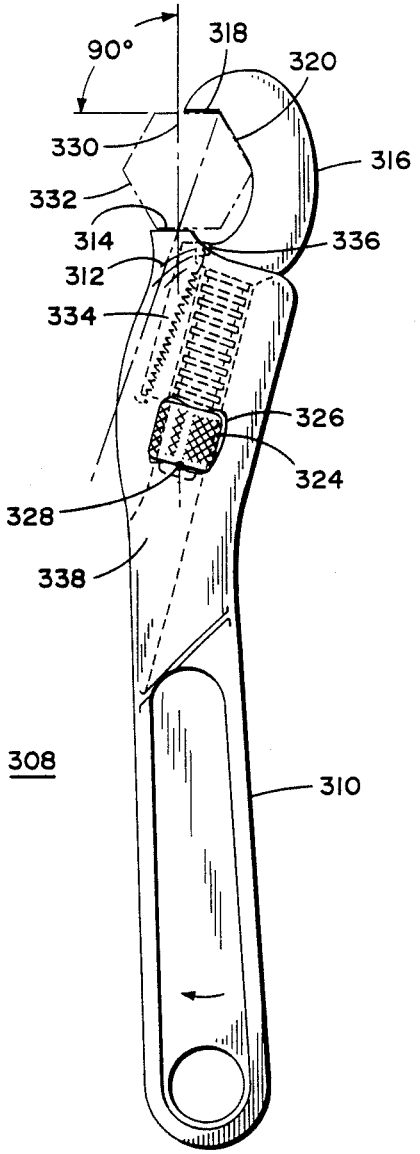
FIG. 13*a* is a plan view of an alternate embodiment of the ratchetable adjustable wrench in which the moveable jaw is the outermost jaw of the wrench.
Figure 13B:
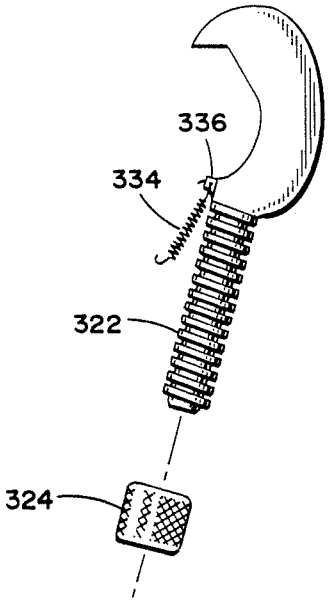

FIG. 13*a* is another embodiment of an adjustable, ratchetable wrench wherein the moveable jaw 316 extends beyond the fixed jaw 312 and moves away from or towards the fixed or stationary jaw member 312. Thus, as shown in FIG. 13*a*, wrench 308 includes handle 310, a fixed jaw member 312 having a working face 314 and a moveable jaw member 316 having a first working face 318 and a second working face 320. It will be noted that the moveable jaw member 316, as shown in FIG. 13*b*, is attached to a threaded member 322 which passes through a knurled nut 324. As shown in FIG. 13*a*, the knurled nut 324 sits in a slot 326 in handle 310. It will also be noted in FIG. 13*a* that the pivot point 328 of moveable jaw member 316 is on a line 330 which passes through the center of the parallel faces or sides of the nut 332 which is held by the wrench. It will also be noted that the angle of movement of the moveable jaw portion 316 with respect to line 330 is 15° as was previously explained with relation to FIG. 10. A spring 334 is shown in FIG. 13*b* which is coupled between lip 336 and the body of the wrench 310 which causes the moveable jaw to be returned to its normal position after it ratchets. Again, slot 338 in the wrench as shown in FIG. 13*a* is elongated as it moves away from knurled nut 326 to allow the threaded portion of moveable jaw 322 to pivot about pivot point 328.

Figure 14:
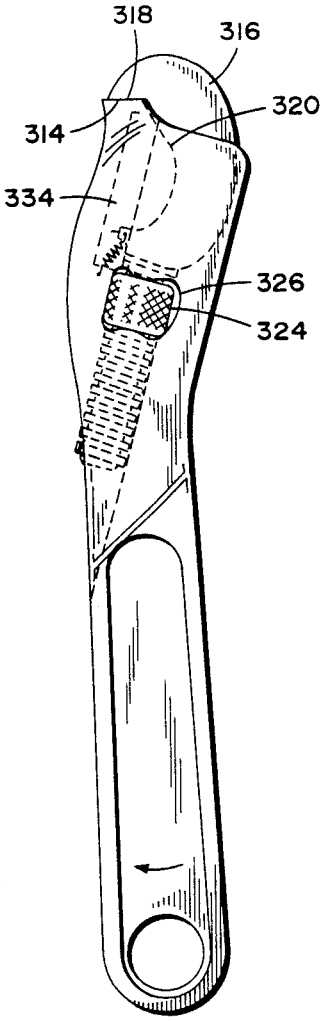
* and FIG. 14 is a plan view of the wrench of FIG. 13*a* in the closed position.

FIG. 14 illustrates the novel wrench in FIG. 13 in its closed position.

Thus, it will be seen that each of the wrenches disclosed in FIGS. 11, 12, and 13 are so constructed that they operate in accordance with the diagram in FIG. 10. These relationships hold constant for each of the wrenches and are necessary to have an adjustable wrench which is also ratchetable.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined in the appended claims.

I claim:

1. An adjustable wrench comprising:

a. a handle, b. a stationary jaw member integrally formed at an angle with said handle and having at least one work face and movable jaw support surface separated by a 60° included angle, said stationary jaw member being closed to form a closed end adjustable wrench with a stationary jaw member face and a movable jaw member face forming two parallel sides of a hexagon; wherein said movable jaw is a bolt having a jaw member face parallel to said stationary jaw member face and wherein said stationary jaw member and said movable jaw support surface are elongated in a convergent direction to accommodate various size objects; and c. a movable jaw riding on said support surface and continuously supported thereby when under stress during its entire range of movement, said movable jaw having only a single work face thereon, said single face being parallel to said stationary member face such that pressure applied to an object placed in between said stationary jaw member face and said movable jaw member face creates a force a part of which is applied to said movable jaw member in a direction perpendicular to the direction of travel of said movable jaw member so as to force said movable jaw member against said support surface to prevent bending or twisting of said movable jaw member.

2. An adjustable wrench as in claim 1 wherein said bolt is threaded and said moveable jaw adjustment is caused by rotating said bolt.

3. An adjustable wrench as in claim 2, wherein said rotatable bolt has said adjustable jaw formed by conical shaped end with an included angle of 120° whereby the side of said cone will form said adjustable jaw in any rotatable position of said bolt.

4. An adjustable wrench as in claim 3 further including:

a. a threaded passage extending through said head member in alignment with said moveable jaw support surface for receiving said threaded bolt and
b. means on the outer end of said bolt for providing a finger grip for turning said bolt.

5. An adjustable wrench as in claim 1 wherein said moveable jaw is adjusted by sliding said bolt.

6. An adjustable wrench as in claim 5 further including:
a. a recess in said moveable jaw support member,
b. a projection on the bottom of said slideable bolt for mating with said recess,
c. a first orifice in said head member in alignment with said moveable jaw support surface,
d. a second orifice on said wrench spaced from and in alignment with said first orifice, and
e. a threaded nut mounted between said first and second orifices for receiving said bolt and causing said bolt to have a sliding motion upon rotation of said nut.

7. An adjustable wrench as in claim 5 further including:
a. partial threads formed on the lower part of said bolt,
b. a recess in said moveable jaw support surface,
c. a projection on at least a portion of the lower part of said bolt for mating with said recess and
d. means on said in wrench in operative relationship with said slidable bolt to move said bolt toward or away from said stationary jaw member.

8. An adjustable wrench as in claim 7 wherein said means to move said bolt comprises:
a. a cavity in said wrench body in communication with said partial threads on said bolt, and
b. a nut having external threads mounted in said cavity for cooperating with said partial threads to move said bolt and associated moveable jaw face toward or away from said stationary jaw face.

9. An adjustable wrench comprising:
a. a handle,
b. a stationary jaw member integrally formed at an angle with said handle and having at least one work face and movable jaw support surface separated by a 60? included angle, said stationary jaw member being open to form an open end adjustable wrench, and wherein
c. said movable jaw is a sliding bolt member having a jaw member parallel to said stationary face riding on said support surface and continuously supported thereby when under stress during its entire range of movement, said movable jaw having only a single work face thereon, said single face being parallel to said stationary member face such that pressure applied to an object placed in between face creates a force a part of which is applied to said movable jaw member in a direction perpendicular to the direction of travel of said movable jaw member so as to force said movable jaw member against said support surface to prevent bending or twisting of said movable jaw member.

10. An adjustable wrench as in claim 9 further including:
a. a recess in said moveable jaw support surface,
b. a projection on the lower part of said bolt for mating with said recess, and
c. means on said wrench in operative relationship with said slidable bolt to move said bolt toward or away from said stationary jaw member.

11. An adjustable wrench as in claim 10 wherein said means to move said bolt comprises:
a. partial threads formed on the lower part of said bolt,
b. a cavity in said wrench body in communication with said partial threads on said bolt, and
c. a nut having external threads thereon mounted in said cavity and cooperating with said partial threads to move said bolt and associated moveable jaw toward or away from said stationary jaw.

12. An adjustable ratchet wrench for variable size hexnuts comprising:
a. a handle,
b. a stationary jaw member having at least one working face and a support surface for a moveable jaw member all integrally formed,
c. a ratchetable, adjustable jaw member dependent upon said support surface and pivotally attached to said wrench at a point which always lies on a line passing through the center of the parallel sides of said hexnut and having a face parallel to said at least one stationary jaw member working face and at an angle of 75° to said support surface whereby force applied to said ratchetable jaw member face in one direction causes it to be held tightly against said support surface and force applied in the opposite direction causes it to pivot away from said support surface, and resilient means coupled to said wrench and said ratchetable jaw member for returning said ratchetable jaw member to said support surface after said force is removed thereby causing ratcheting of said jaw member.

13. An adjustable, ratchet wrench for variable size nuts comprising:
a. a handle having a moveable jaw support surface and a fixed jaw with at least portions of two working faces forming an angle of 120° integrally formed therewith, a first one of said working faces forming an angle of 75° with said support surface,
b. a ratchetable jaw member carried by said support surface and having a working face parallel to said one of said fixed jaw working faces, and
c. means for moveably adjusting said ratchetable jaw member toward and away from said one parallel fixed working face whereby the size of said wrench may be adjusted for variable size nuts while maintaining said ratchet capability.

14. An adjustable ratchet wrench as in claim 13 wherein:
a. said ratchetable jaw member working face is at an angle of 105° to said support surface whereby force applied to said ratchetable jaw member working face in one direction causes it to be held tightly against said support surface and force applied in the opposite direction causes it to pivot away from said support surface and
b. resilient means coupled to said wrench and said ratchetable jaw member for returning said jaw member to said support surface after said force is removed thereby causing ratcheting of said jaw member.

15. An adjustable ratchet wrench as in claim 14 further including:
a. a second one of said working faces on said fixed jaw abutting said support surface, and
b. an included angle of 135° between said support surface and said second working face.

16. An adjustable ratchet wrench as in claim 15 wherein:

a. The length of said second working face determines the maximum size of hexnut that can be accommodated by said wrench and b. The length of said at least one working face is sufficient to extend no more than one half the distance along one face of the largest size hexnut accommodated by said wrench.

17. An adjustable ratchet wrench as in claim 16 wherein the outer end of said at least one working face arches away from said nut to enhance ratcheting.

18. An adjustable ratchet wrench for variable size nuts comprising:

a. a handle having a fixed jaw integrally formed thereon, said fixed jaw having a working face for contacting at least one face of said nut, b. a moveable jaw on s aid handle, said movable jaw having a working face for only contacting substantially the upper one half portion of a face of any nut opposite that face contacted by said fixed jaw and a lower portion curved away from said working face and said nut to facilitate ratcheting, c. means for adjusting said moveable jaw towards or away from said fixed jaw to accommodate variable size nuts, and d. means for obtaining a ratcheting relationship between said fixed jaw and said moveable jaw whereby an adjustable ratchetable wrench is obtained.

19. An adjustable wrench as in claim 18 wherein said fixed jaw includes two working faces having an included angle of 120° to accommodate hexnuts.

20. An adjustable wrench as in claim 19 wherein said moveable jaw is pivotally attached at a pivot point to said handle.

21. An adjustable wrench as in claim 20 wherein said pivot point at any position of said moveable jaw lies on a line passing through the center of the parallel sides of the nut held by the abutting fixed and moveable jaws.

22. An adjustable wrench as in claim 21 further including:

a. a support surface on said handle for said moveable jaw and b. an angle of 15° between said support surface and the line passing through the center of the parallel sides of the nut held by the abutting fixed and moveable jaws and said pivot point.

23. An adjustable ratchet wrench for variable size nuts comprising:

a. a handle having a fixed jaw integrally formed thereon, said fixed jaw having a working face for only contacting substantially the upper one-half portion of a face of any nut and a lower portion curved away from said working face and said nut to facilitate ratcheting, b. a moveable jaw mounted on said handle, said moveable jaw having a working face for contacting a face of said nut opposite the face contacted by said fixed jaw, c. means for adjusting said moveable jaw towards or away from said fixed jaw to accommodate variable size nuts, and d. means for obtaining a ratcheting relationship between said fixed jaw and said moveable jaw whereby an adjustable ratchet wrench is obtained.

* * * * *

UNITED STATES PATENT AND TRADEMARK OFFICE

CERTIFICATE OF CORRECTION

PATENT NO. 4,838,132

DATED June 13, 1989

INVENTOR(S) Donald Pyles

It is certified that error appears in the above-identified patent and that said Letters Patent is hereby corrected as shown below:

Column 3, line 33, delete "176,005,".

Column 8, line 33, after "a", insert --nut--.

Column 10, line 63, after "by", insert --a--.

Column 11, line 44, after "60", delete "?" and insert --°--.

Column 11, line 54, after "between", insert --said stationary jaw member face and said movable jaw member--.

Column 12, line 29, before "resilient", insert --d.--.

Signed and Sealed this

Twenty-ninth Day of September, 1992

*Attest:*

DOUGLAS B. COMER

*Attesting Officer*

*Acting Commissioner of Patents and Trademarks*